US006905032B2

(12) United States Patent
Brettschneider et al.

(10) Patent No.: US 6,905,032 B2
(45) Date of Patent: Jun. 14, 2005

(54) SCREENS FOR FIBROUS PAPER SUSPENSIONS AND PROCESS FOR MAKING SAME

(75) Inventors: Werner Brettschneider, Ravensburg (DE); Jürgen Fey, Ravensburg (DE)

(73) Assignee: Voith Paper Patent GmbH, Heidenheim (DE)

( * ) Notice: Subject to any disclaimer, the term of this patent is extended or adjusted under 35 U.S.C. 154(b) by 361 days.

(21) Appl. No.: 10/023,995

(22) Filed: Dec. 21, 2001

(65) Prior Publication Data

US 2002/0079072 A1 Jun. 27, 2002

(30) Foreign Application Priority Data

Dec. 22, 2000 (DE) ..... 100 65 931

(51) Int. Cl.[7] ..... B01D 39/10

(52) U.S. Cl. ..... 210/498; 209/397; 29/896.62; 29/525

(58) Field of Search ..... 29/896.62, 525; 210/415, 498, 499; 209/270, 271, 273, 306, 379, 397; 162/251, 261

(56) References Cited

U.S. PATENT DOCUMENTS

| | | | | | |
|---|---|---|---|---|---|
| 2,465,056 | A | * | 3/1949 | Bond | 241/88.3 |
| 3,150,038 | A | * | 9/1964 | Rich | 162/237 |
| 3,972,974 | A | * | 8/1976 | Pico | 264/267 |
| 4,832,832 | A | | 5/1989 | Fujiwara et al. | |
| 5,023,986 | A | * | 6/1991 | Gero et al. | 29/896.6 |
| 5,041,212 | A | * | 8/1991 | Gero et al. | 209/273 |
| 5,588,497 | A | * | 12/1996 | Thorburn | 175/420.1 |
| 5,665,207 | A | * | 9/1997 | Aikawa | 162/261 |
| 5,789,686 | A | * | 8/1998 | Massa et al. | 75/240 |
| 6,254,729 | B1 | * | 7/2001 | Doelle et al. | 162/251 |

FOREIGN PATENT DOCUMENTS

| | | | | |
|---|---|---|---|---|
| DE | 19506084 | | 8/1996 | |
| EP | 0205623 | | 12/1986 | |
| EP | 0479203 | | 4/1992 | |
| EP | 0807709 | | 11/1997 | |
| JP | 3-249296 | * | 11/1991 | D21D/5/16 |

* cited by examiner

*Primary Examiner*—Matthew O. Savage
(74) *Attorney, Agent, or Firm*—Greenblum & Bernstein, P.L.C.

(57) ABSTRACT

Process for manufacturing screens and screens suitable for use in wet screening fibrous paper suspensions, in which the screens include at least one screen plate having a number of sorting apertures. The process includes providing a number of fastening openings in the at least one screen plate, and inserting profiled pieces into the fastening openings. At least a portion of the profiled pieces are arranged to project beyond a screen surface.

36 Claims, 3 Drawing Sheets

Fig. 1
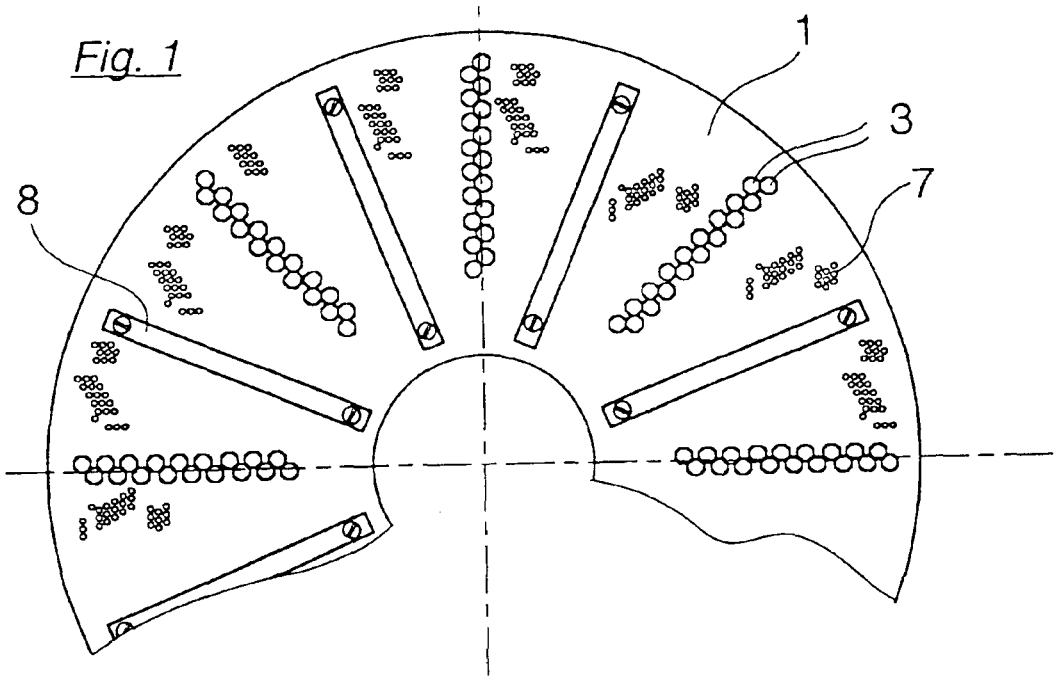
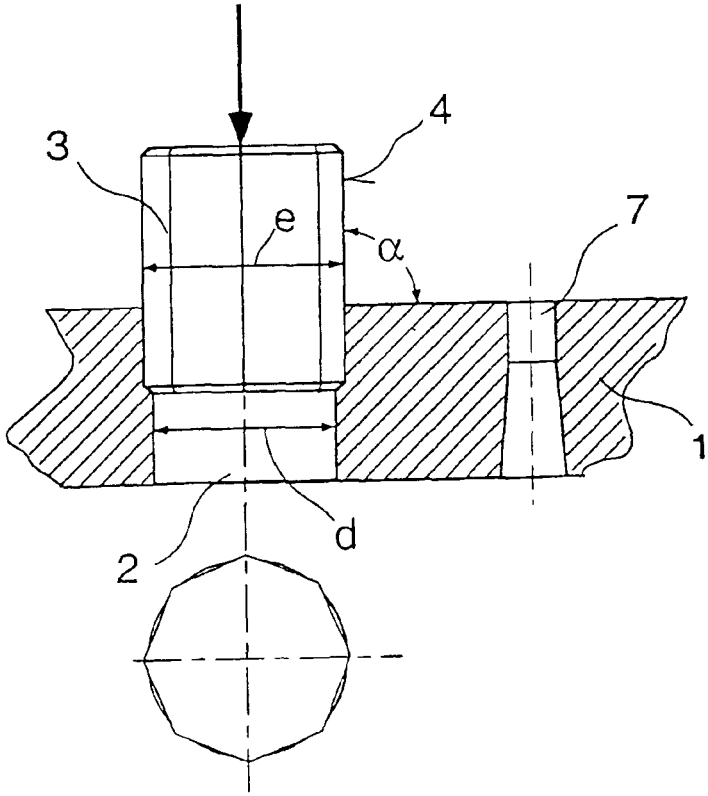
Fig. 2

SCREENS FOR FIBROUS PAPER SUSPENSIONS AND PROCESS FOR MAKING SAME

CROSS-REFERENCE TO RELATED APPLICATIONS

The present application claims priority under 35 U.S.C. § 119 of German Patent Application No. 100 65 931.4, filed on Dec. 22, 2000, the disclosure of which is expressly incorporated by reference herein in its entirety.

BACKGROUND OF THE INVENTION

1. Field of the Invention

The invention relates to a process for manufacturing screens suitable for use in wet screening fibrous paper suspensions. Such screens include at least one screen plate which has a number of sorting apertures.

2. Discussion of Background Information

When processing pulp, screens are used to treat the fibrous suspension in wet screening, e.g., in sorting machines in cellulose and paper manufacturing. Here, in most cases, non-fibrous contaminants are to be retained at a screen because of their size and subsequently eliminated. Here, the fibers can pass through the sorting apertures together with some of the water. Frequently, screens are added to pulpers as well, retaining coarse contaminants and the portion of the paper not yet dissolved. However, there are other applications as well, e.g., in order to fractionate fibrous suspensions according to fiber lengths. In principle, such screens can be flat or curved. They are mostly made of metal, e.g., high-quality steel alloys. They are called screen baskets when they are designed in a rotationally symmetrical way, e.g., cylindrically.

Scrapers passing at close range are generally used to prevent the sorting apertures getting clogged. Their effectiveness can be improved decisively by projecting ridges, because they produce turbulence that prevents solid materials settling.

In many applications, such screens are exposed to considerable wear. This is primarily due to the fact that a certain load of contaminants also arrives in the screen area, e.g., in the case of the above-mentioned use in fibrous paper suspensions. This load of contaminants may comprise metal pieces, broken glass, sand, or stones, for example. Since it is the purpose of the screens to retain this load of contaminants, they cause considerable wear in combination with the passing scraper. Therefore, oblong plating made from wear- resistant materials, e.g., by built-up welding, has been used for quite some time. In other cases, prefabricated wear ridges are mounted onto the screen plate. Therefore, in addition to the above-mentioned increase in turbulence, such ridges or plating can protect the screen from wear. Mounted ridges are known, e.g., from DE 195 06 084 A1. Their production and mounting require higher expenses, particularly because they frequently have wear-resistant, but brittle material.

Even if the screens already serve their purpose, there is always the requirement to reduce the cost of the screens, which must also be considered parts subject to wear, or to improve them. Here, the components in question are actually rather expensive objects that frequently require replacement at certain intervals. Therefore, the manufacturers of such screens are concentrating in particular on producing them as inexpensively as possible.

SUMMARY OF THE INVENTION

The invention is provides a process for producing screens, which will either reduce the costs without causing the quality, particularly their strength, to suffer, or improve their wear-resistance, thus, extending the life of the screen.

Accordingly, the process of the instant invention includes providing the screen plate with a number of fastening openings, and, subsequently, inserting profiled pieces into these fastening openings such that they project beyond the screen surface.

The profiled pieces used according to the invention are relatively easy to manufacture as standard parts, even when they are made of very hard, highly wear-resistant material, such as cemented carbide. They can easily be attached by pressing them into a fastening hole in the screen plate, which is usually made of a tough, high-strength metal alloy. Here, the material of the screen plate preferably deforms and adapts to the shape of the profiled piece. Welding is not necessary. Worn profile pieces can be knocked out and replaced with new ones.

Flat screens are particularly well suited for production according to this process. They are primarily used wherever rough operation leads to high wear stress. The profiled pieces can easily be pressed in flat screens. Usually, the screen devices, into which flat screens are to be installed, are provided with a support construction to prevent the screen sagging. Thus, a potential weakening of the screen plate due to the fastening holes is generally not a disadvantage.

However, if the screen plate were weakened too severely by fastening holes positioned close together, the profiled pieces can also be spaced out. Another possibility is to provide the profiled pieces with a step, so that the part projecting beyond the screen surface is wider than the one pressed into the fastening holes. Although this is more expensive, the fastening holes could be spaced further apart. When the screen plate is sufficiently thick, the fastening holes can be pocket holes so that the area of the screen plate under tensile stress need not be perforated or only to a small extent (ventilation during pressing).

The present invention is directed to a process for manufacturing screens suitable for use in wet screening fibrous paper suspensions, in which the screens include at least one screen plate having a number of sorting apertures. The process includes providing a number of fastening openings in the at least one screen plate, and inserting profiled pieces into the fastening openings. At least a portion of the profiled pieces are arranged to project beyond a screen surface.

In accordance with a feature of the instant invention, side surfaces of the profiled pieces can be positioned essentially perpendicular to the screen surface.

According to another feature of the invention, the projection of the profiled pieces beyond the screen surface may be at least about 2 mm and no more than about 30 mm.

Further, the profiled pieces can have a regular, polygon-shaped profile. The regular, polygon-shaped profiled piece may be an octagon.

The profiled pieces can be made of highly wear-resistant material. Further, the profiled pieces may be made of a sintered metal alloy. Moreover, a tungsten carbide powder can be sintered to produce the profiled pieces.

A cross-sectional area of the profiled pieces may be between about 50 $mm^2$ and about 200 $mm^2$.

In accordance with another feature of the present invention, the profiled pieces project can beyond the screen plate at a height of between about 2 mm and about 15 mm.

The fastening holes can be circular with diameter that is smaller than a corner measurement of the profiled pieces. The inserting of the profiled pieces may include forced fitting the profiled pieces into the fastening holes.

The fastening holes may be provided to go through the at least one screen plate and to have a larger cross section on a side of the at least one screen plate at which the profiled pieces are inserted than on an opposite side of the at least one screen plate.

Moreover, the fastening holes can be arranged in groups, and the fastening holes of each group can be arranged in a line. Edges of adjacent fastening holes in a group may be spaced only a short distance from one another. Further, the lines of the fastening holes can be straight. Alternatively, the lines of the fastening holes may be curved, or the lines of the fastening holes may have a zigzag shape.

According to still another feature of the invention, the fastening holes can be positioned separately on the at least one screen plate and are spaced out at a distance of at least about 50 mm.

In accordance with a further feature of the invention, the process can include mounting ridges onto the at least one screen plate.

According a still another feature of the invention, the sorting apertures may have a circular cross section with a diameter between about 1 mm and about 30 mm.

In accordance with a still further feature of the invention, the at least one screen plate can be made from a high-strength metal alloy.

The present invention is directed to a screen suitable for use in wet screening fibrous paper suspensions. The screen includes at least one screen plate having a plurality of sorting apertures and a plurality of fastening openings, and a plurality of profiled pieces structured and arranged to be insertable into said fastening openings, and such that, when fully inserted into said fastening openings, at least a portion of the profiled pieces are arranged to project beyond a screen surface.

In accordance with a feature of the instant invention, the plurality of profiled pieces can include polygonal shapes. Further, the polygonal shapes may be octagons.

In accordance with yet still another feature of the present invention, ridges are mounted onto the at least one screen plate.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 1 illustrates a partial view of a screen produced according to the instant invention;

FIGS. 2 and 3 illustrate a sectional view of a part of the screen depicted in FIG. 1;

DETAILED DESCRIPTION OF THE PRESENT INVENTION

Figure 3:
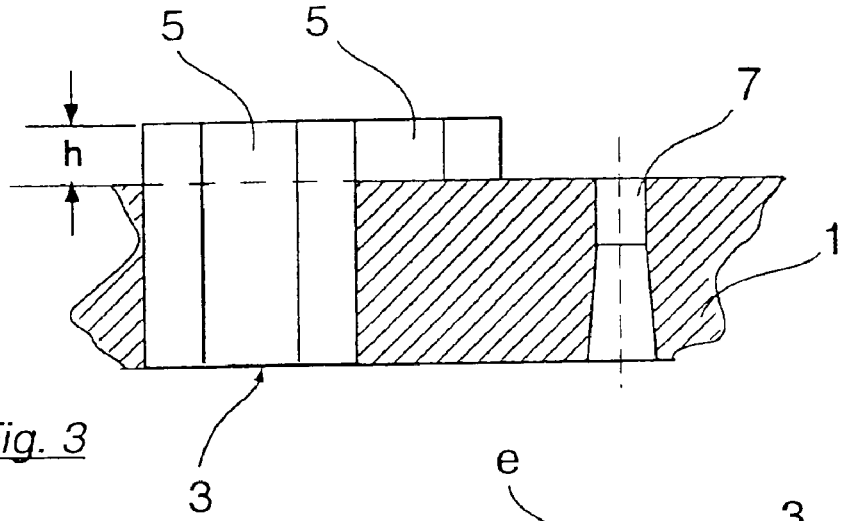

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIG. 1 shows the part of the screen in which a number of profiled pieces 3 are inserted according to the invention into the screen plate 1. They are concentrated in groups such that each group forms one ridge. The screen is flat and has a circular external diameter. In addition to the profiled pieces, the screen is also provided with screwed-on ridges 8. The fastening holes that are usually provided on such a screen are not shown here. In this figure, the sorting apertures 7 are marked only to a small extent. The line of vision in this figure is turned towards that side of the screen where the suspension to be screened flows in and where the screen scraper is positioned as well.

The section through the screen plate 1 shown in FIG. 2 gives an example of a sorting aperture 7 and the lower part of the fastening hole 2. Preferably, it is circular and has a minimum diameter d slightly smaller than the corner measurement or maximum cross sectional dimension e of an insertion portion the profiled piece 3 to be pressed into the openings. Here, the latter has an octagonal profile with a regular cross section. The representation shows the moment in the production process when the profiled piece 3 is pressed into the screen plate 1 approximately half-way. The side surfaces 4 of the profiled piece 3 are positioned at a right angle a to the surface of the screen. The sorting aperture 7 has a circular-cylindrical shape at its intake side, which then turns into a conical expansion (seen in the flow direction). Such sorting apertures are typical for screens that are to be used for sorting contaminants of fibrous paper suspensions. At the bottom edge of FIG. 2, the clamp fitting between round fastening holes and octagonal profiled piece is shown in top view.

In FIG. 3, the pressing process is completed, i.e., the profiled piece 3 completely penetrates the screen plate 1. It is discernible that the profiled piece 3 projects beyond the top of the screen plate 1 due to its length. The projection 5 has a height h, which is generally several millimeters. Here, another projection 5 is discernible as well, partially covered by the profiled piece 3 positioned in front of it, which belongs to another profiled piece inserted into the screen plate 1.

Figure 4:
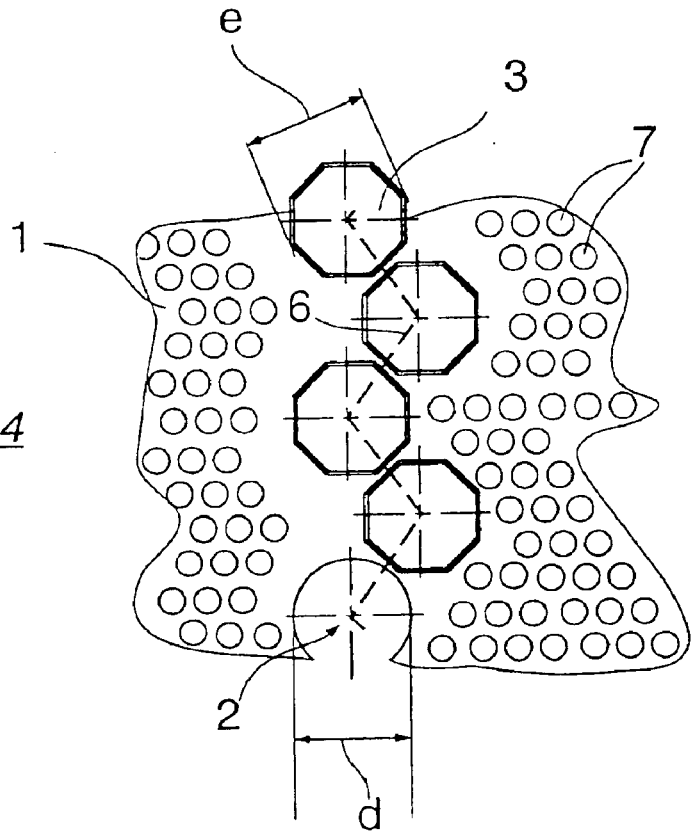
FIG. 4 illustrates a somewhat more detailed top view of the screen according to the instant invention.

FIG. 4 shows in greater detail the arrangement of several correlating profiled pieces 3. Part of a group of profiled pieces 3 is discernible, arranged in a zigzag line 6 here. At the bottom edge of this screen plate section there is a fastening hole 2 with a diameter d into which the corresponding profiled piece has not yet been inserted. Furthermore, this representation shows sorting apertures 7.

Figure 5:
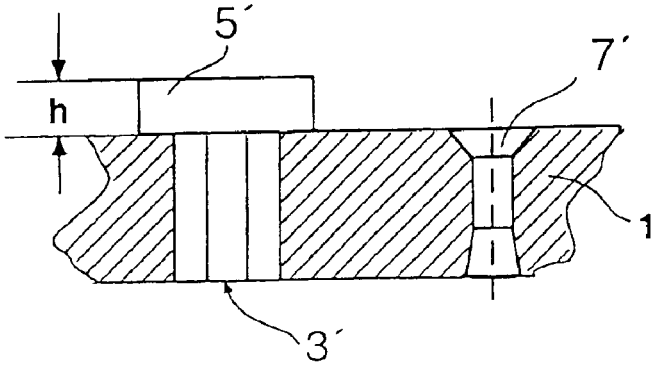
FIG. 5 illustrates a partial sectional view through a screen with a modified profiled piece.

As mentioned above, it is also possible to produce the profiled pieces such that they have a projection 5' as provided in FIG. 5, with a larger width adjacently above the screen surface and in the direction toward the adjacent profiled piece than the lower inserted part of the profiled piece 3. Thus, the fastening holes can be spaced further apart, even when the projections 5 touch one another or have a very close spacing. For example, FIG. 5 shows an example of a modified sorting aperture 7' with a bevel at the intake side. This shape is particularly advantageous for a high screen throughput and can be used in the other cases as well.

Figure 6:
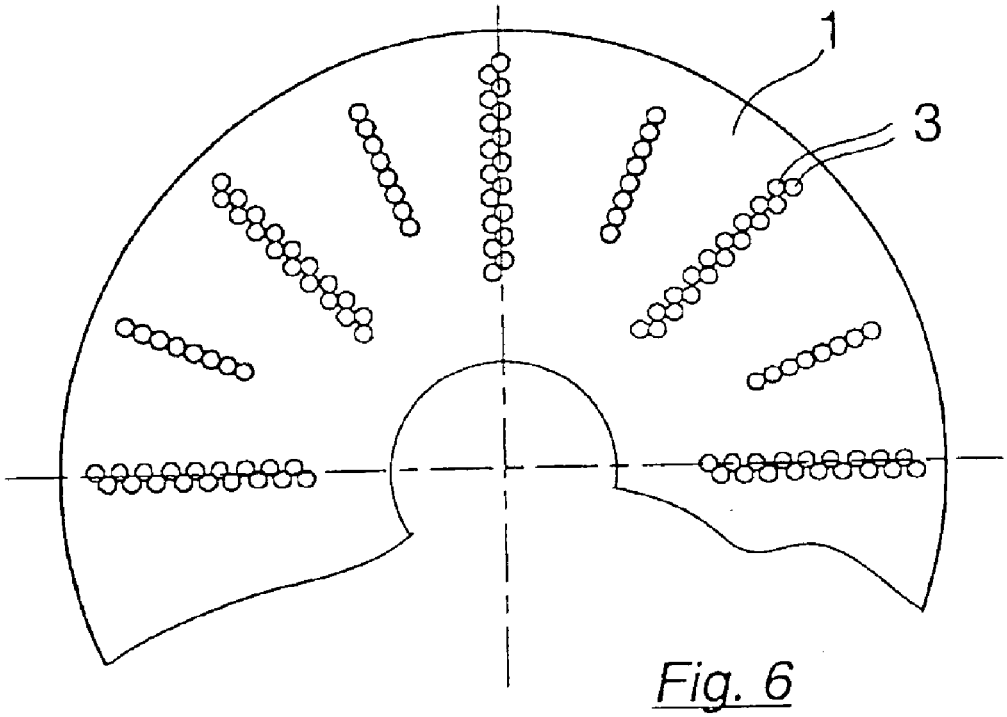
FIGS. 6 and 7 illustrate a modified arrangement in which each of the profiled pieces are inserted according to the invention.

While FIG. 1 shows the combination of profiled pieces 3 fitted with ridges 8, it is also possible, as shown in FIG. 6, to create all elevations required on the screen plate by the profiled pieces 3 already described. Here, the groups of the profiled pieces can be arranged such that they either form linearly directed rows or that adjacent profiled pieces are staggered. In all these cases, ridge-shaped elevations that have the known turbulence-enhancing effect, are created on the intake side of the screen. They are arranged either strictly radially, as shown here, or they are set at an oblique angle to help solid particles to slide off. They may also be arched.

Figure 7:
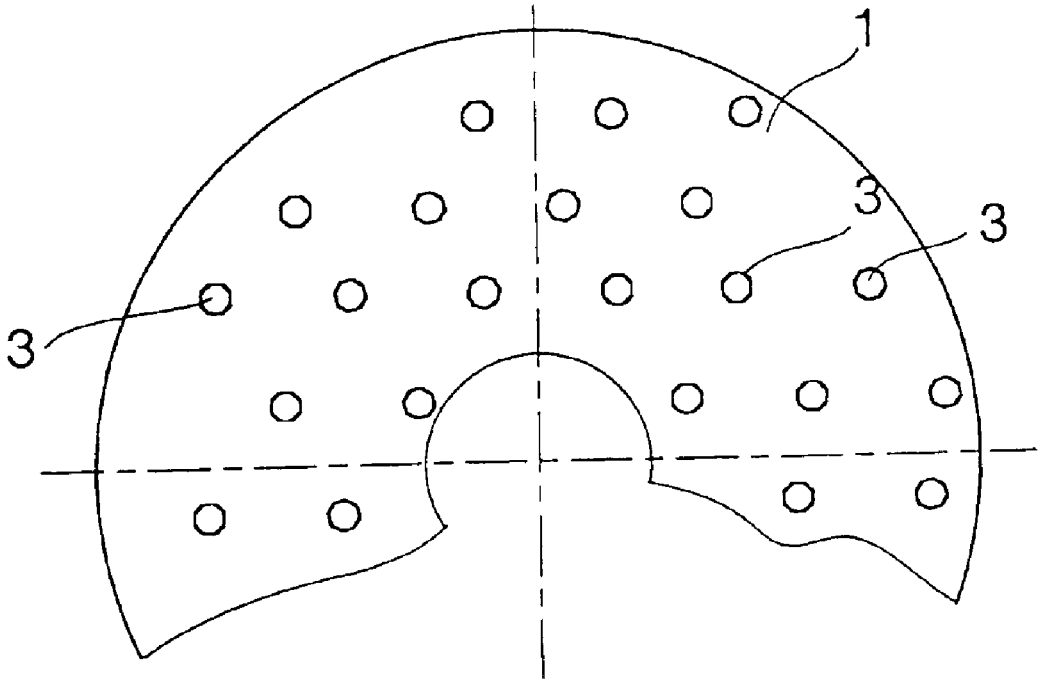

However, it is also conceivable to insert the profiled pieces into the screen plate separately. FIG. 7 shows one such version. Hereby, in particular, contaminants can be crushed in a controlled way, with the distance to the rotor making it possible to control the effect.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for manufacturing screens suitable for use in wet screening fibrous paper suspensions, in which the screens include at least one screen plate having a number of sorting apertures, process comprising:

providing a number of fastening openings in the at least one screen plate, said fastening openings being circular and having a minimum diameter;

providing profiled pieces each having an insertion portion, each said insertion portion having polygonal cross-sectional shape with a maximum cross-sectional dimension that is greater than the minimum diameter of said fastening openings, and press inserting said insertion portions of the profiled pieces into the fastening openings, wherein at least a portion of the profiled pieces are arranged to project beyond a screen surface.

2. The process in accordance with claim 1, wherein side surfaces of the profiled pieces are positioned essentially perpendicular to the screen surface.

3. The process in accordance with claim 1, wherein the projection of the profiled pieces beyond the screen surface is at least about 2 mm and no more than about 30 mm.

4. The process in accordance with claim 1, wherein the polygonal cross-sectional shape is an octagon.

5. The process in accordance with claim 1, wherein the profiled pieces are made of highly wear-resistant material.

6. The process in accordance with claim 5, wherein the profiled pieces are made of a sintered metal alloy.

7. The process in accordance with claim 6, wherein a tungsten carbide powder is sintered to produce the profiled pieces.

8. The process in accordance with claim 1, wherein a cross-sectional area of the profiled pieces is between about 50 $mm^2$ and about 200 $mm^2$.

9. The process in accordance with claim 1, wherein the profiled pieces project beyond the screen surface at a height of between about 2 mm and about 15 mm.

10. The process in accordance with claim 1, wherein the fastening holes are provided to go through the at least one screen plate and to have a larger diameter adjacent the screen surface than adjacent an opposite side of the at least one screen plate.

11. The process in accordance with claim 1, wherein the fastening holes are arranged in groups, and that the fastening holes of each group are arranged in a line.

12. The process in accordance with claim 11, wherein the lines of the fastening holes are straight.

13. The process in accordance with claim 11, wherein the lines of the fastening holes have a zigzag shape.

14. The process in accordance with claim 1, wherein the fastening holes are spaced apart from one another by a distance of at least about 50 mm.

15. The process in accordance with claim 1, further comprising mounting ridges onto the at least one screen plate.

16. The process in accordance with claim 1, wherein the sorting apertures have a diameter between about 1 mm and about 30 mm.

17. The process in accordance with claim 1, wherein the at least one screen plate is made from a high-strength metal alloy.

18. A screen suitable for use in wet screening fibrous paper suspensions, comprising:

at least one screen plate having a plurality of sorting apertures and a plurality of fastening openings, said fastening opening is being circular and having a minimum diameter; and a plurality of profiled pieces each having an insertion portion, each said insertion portions having a polygonal cross-sectional shape with a maximum cross-sectional dimension that is greater than the minimum diameter of said fastening openings, wherein said insertion portions are pressed into said fastening openings, and at least a portion of the profiled pieces project beyond a screen surface.

19. The screen in accordance with claim 18, wherein said polygonal shapes are octagons.

20. The screen in accordance with claim 18, wherein side surfaces of said plurality of profiled pieces are positioned essentially perpendicular to the screen surface.

21. The screen in accordance with claim 18, wherein the projection of said plurality of profiled pieces beyond said screen surface is at least about 2 mm and no more than about 30 mm.

22. The screen in accordance with claim 18, wherein said plurality of profiled pieces are made of highly wear-resistant material.

23. The screen in accordance with claim 22, wherein said plurality of profiled pieces are made of a sintered metal alloy.

24. The screen in accordance with claim 23, wherein a tungsten carbide powder is sintered to produce said plurality of profiled pieces.

25. The screen in accordance with claim 18, wherein a cross-sectional area of said plurality of profiled pieces is between about 50 $mm^2$ and about 200 $mm^2$.

26. The screen in accordance with claim 18, wherein said plurality of profiled pieces project beyond the screen plate at a height of between about 2 mm and about 15 mm.

27. The screen in accordance with claim 18, wherein the fastening holes are provided to go through the at least one screen plate and to have a larger diameter adjacent the screen surface than adjacent an opposite side of the at least one screen plate.

28. The screen in accordance with claim 18, wherein said fastening holes are arranged in groups, and that said fastening holes of each group are arranged in a line.

29. The screen in accordance with claim 28, wherein said lines of said fastening holes are straight.

30. The screen in accordance with claim 28, wherein said lines of said fastening holes have a zigzag shape.

31. The screen in accordance with claim 18, wherein the fastening holes are spaced apart from one another by a distance of at least about 50 mm.

32. The screen in accordance with claim 18, further comprising ridges mounted onto said at least one screen plate.

33. The screen in accordance with claim 18, wherein said sorting apertures have a circular cross section with a diameter between about 1 mm and about 30 mm.

34. The screen in accordance with claim 18, wherein said at least one screen plate is made from a high-strength metal alloy.

35. A process for manufacturing screens suitable for use in wet screening fibrous paper suspensions, in which the screens include at least one screen plate having a number of sorting apertures, the process comprising:

providing a number of fastening openings in the at least one screen plate; and forming a ridge on the at least one screen plate by inserting a plurality of profiled pieces into the fastening openings in such a manner that at least a portion of the profiled pieces project above a screen surface and in such a manner that adjacent ones of said portions touch one another.

36. A process for manufacturing screens suitable for use in wet screening fibrous paper suspensions, in which the screens include at least one screen plate having a number of sorting apertures, the process comprising:

providing a number of fastening holes and a number of sorting apertures in the at least one screen plate; and inserting profiled pieces into the fastening holes which are larger in diameter than the sorting apertures to form a ridge on the at least one screen plate, wherein a projection of the profiled pieces projects adjacently above the screen surface, and wherein said projections have a larger width than portions of the profiled pieces that are inserted into the fastening holes.

* * * * *